United States Patent [19]

Chen et al.

[11] Patent Number: 4,932,542

[45] Date of Patent: Jun. 12, 1990

[54] BEVERAGE CONTAINER HAVING A DYNAMIC ORNAMENT MOUNTED THERETO

[75] Inventors: Ying-Che Chen, Taipei; Ing-Lang Tsay, Hualian, both of Taiwan

[73] Assignee: Great Truth Co., Ltd., ElMonte, Calif.

[21] Appl. No.: 406,689

[22] Filed: Sep. 13, 1989

[51] Int. Cl.[5] ..... B65D 1/00; B65D 1/04

[52] U.S. Cl. ..... 215/1 R; 215/6; 215/99.5; 446/74; 446/75; 446/77; D7/515; D7/536; D7/537; D7/608

[58] Field of Search ..... 215/1 R, 6, 99.5; 206/315.9; D7/6, 9, 11; 446/75, 77, 74

[56] References Cited

U.S. PATENT DOCUMENTS

| | | | |
|---|---|---|---|
| D. 93,871 | 11/1934 | Griffin | 215/6 X |
| 2,493,922 | 1/1950 | Miller | 215/6 |
| 2,792,696 | 5/1957 | Stayart | 446/76 X |
| 2,903,818 | 9/1959 | Humke | 215/99.5 X |
| 3,051,341 | 8/1962 | Mead | 446/74 X |
| 4,263,734 | 4/1981 | Bradshaw | 215/1 R X |
| 4,681,236 | 7/1987 | Ilk | 215/99.5 |

FOREIGN PATENT DOCUMENTS

| | | | |
|---|---|---|---|
| 1057482 | 5/1959 | Fed. Rep. of Germany | 215/99.5 |
| 610536 | 6/1926 | France | 215/99.5 |
| 1262206 | 4/1961 | France | 215/1 R |

*Primary Examiner*—William Price

*Attorney, Agent, or Firm*—Christensen, O'Connor, Johnson & Kindness

[57] ABSTRACT

A container includes a wall body having a projection extending inwardly from the internal wall surface of the wall body and a cavity extending inwardly from the external wall surface of the wall body into the projection with an opening which is located at the external wall surface. A rotatable member is rotatably and unremovably received in the cavity. A portion of the rotatable member protrudes out from the opening of the wall body. Whereby, the rotatable member can be rotated by a user's fingers so as to enhance the aesthetic quality of the container.

7 Claims, 7 Drawing Sheets

BEVERAGE CONTAINER HAVING A DYNAMIC ORNAMENT MOUNTED THERETO

BACKGROUND OF THE INVENTION

This invention relates to a beverage container having an ornament mounted thereto, and more particularly to a beverage container having a rotatable member serving as a dynamic ornament mounted thereto so as to enhance the aesthetic quality thereof.

Conventionally, a beverage container, such as a cup, is printed with lines, drawings, etc., on the external surface thereof for decorative purposes. However, such beverage container decorations are static and monotonous.

SUMMARY OF THE INVENTION

It is therefore a main object of this invention to provide a beverage container to which is mounted a rotatable member serving as a dynamic ornament so as to enhance the aesthetic quality thereof.

Therefore, in accordance with the present invention, a beverage container comprises a wall body having a projection extending inwardly from the internal wall surface thereof and a cavity extending inwardly from the external wall surface thereof into the projection, which opens at said external wall surface. A rotatable member is rotatably and unremovably received in the cavity. The rotatable member has a portion thereof protruding out from the opening in the wall body. Whereby, the rotatable member can be rotated by a user's fingers so as to enhance the aesthetic quality of the beverage container.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENT

Figure 1:
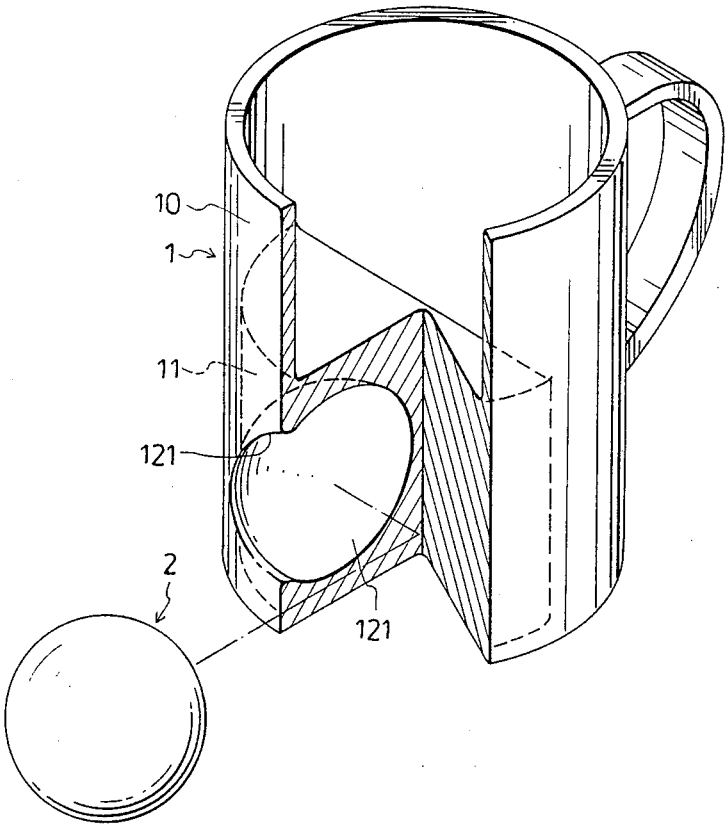
FIG. 1 is a perspective exploded view of a first preferred embodiment of a cup ornamented with a rotatable member according to this invention, in which the cup is partially cut away.
Figure 2:
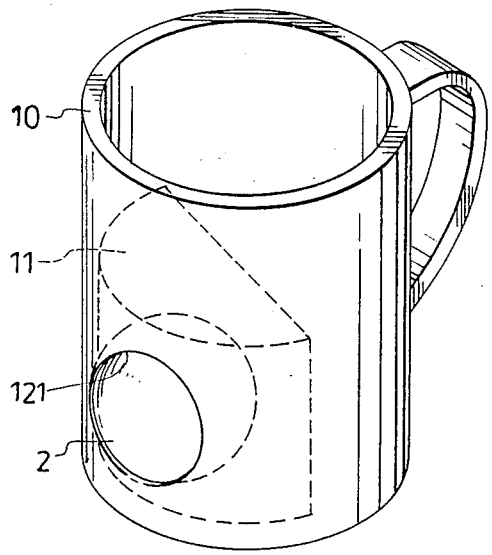
FIG. 2 is a perspective view of the first preferred embodiment of a cup ornamented with a rotatable member according to this invention.

Referring to FIGS. 1, 2, a first preferred embodiment of a cup 1 of this invention includes a wall body 10 having a projection 11 extending inwardly from the internal wall surface thereof. A cavity 12 is formed in the projection 11 the opening 121 of which is located at the external wall surface of the wall body 10. A rotatable member 2 is rotatably and unremovably received in the cavity 12 with a portion thereof protruding out from the opening 121 in the wall body 10, as shown in FIG. 2. Preferably, the projection 11 of the wall body 10 has a volume of half or one fourth of the inner space of the cup 1.

Figure 3:
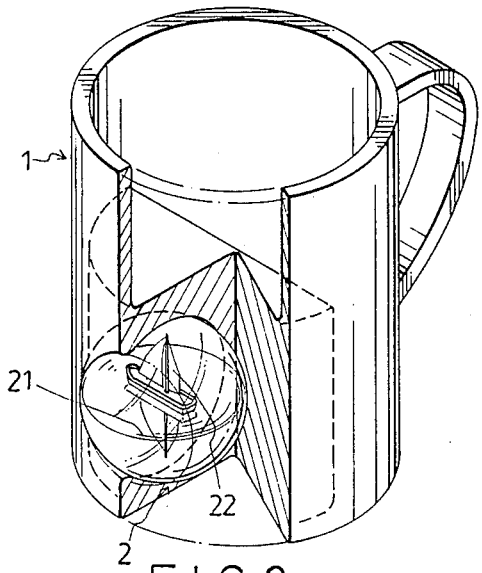
FIG. 3 is a perspective view of a second preferred embodiment of a cup ornamented with a rotatable member according to this invention, in which the cup is partially cut away.
Figure 4:
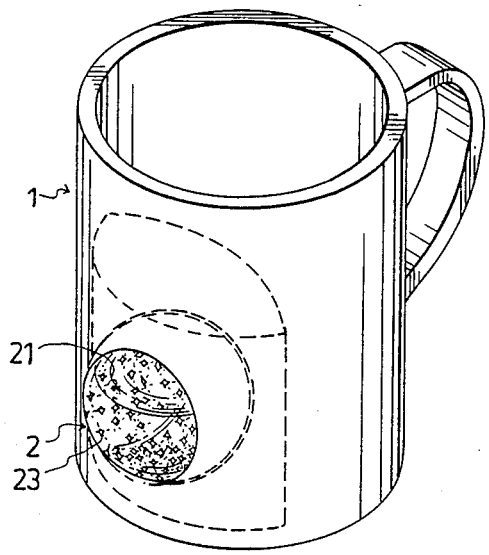
FIG. 4 is a perspective view of the third preferred embodiment of a cup ornamented with a rotatable member according to this invention.
Figure 5:
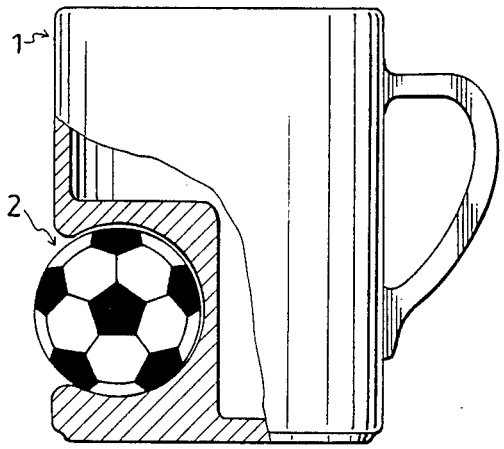
FIG. 5 is a partially sectional side view of the fourth preferred embodiment of a cup ornamented with a rotatable member according to this invention.
Figure 6:
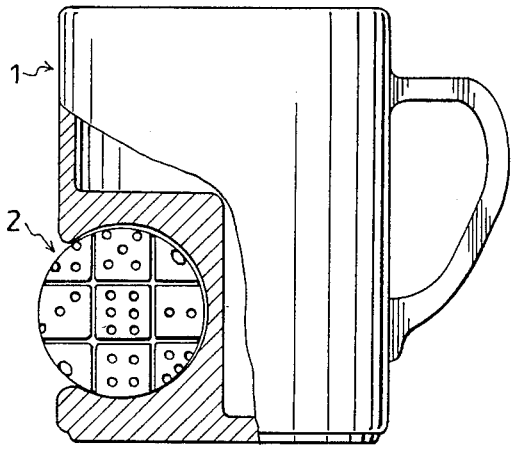
FIG. 6 is a partially sectional side view of the fifth preferred embodiment of a cup ornamented with a rotatable member according to this invention.
Figure 7:
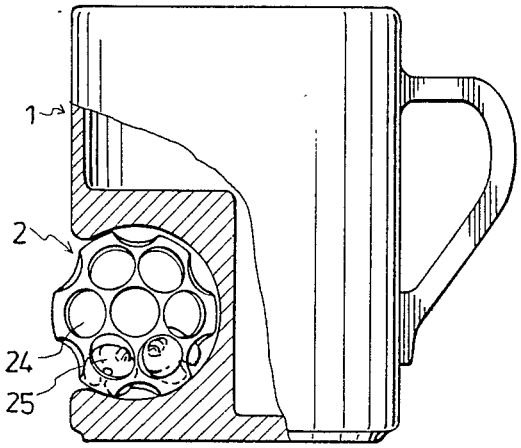
FIG. 7 is a partially sectional side view of the sixth preferred embodiment of a cup ornamented with a rotatable member according to this invention.

The rotatable member 2 may have a variety of forms. For example, referring to FIG. 3, the rotatable member 2 is a transparent, hollow ball which is half-filled with water 21 and has a buoy 22, perhaps in the form of a sailboat, container therein. Alternatively, said transparent hollow ball 2 is filled with water 21 and a plurality of lustrous chips 23 which reflect light, as best illustrated in FIG. 4. Referring to FIG. 5, the rotatable member 2 is in the from of a ball having a checkered external surface. Alternatively, the rotatable member 2 may be in the form of a ball having a external surface marked with dice pips, or a ball having a plurality of bores 24 formed therein in which a plurality of jingle bells 25 are received, as illustrated in FIGS. 6, 7.

Figure 8:
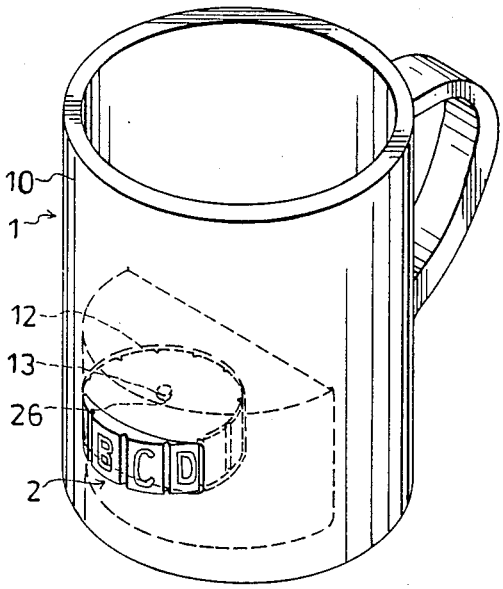
FIG. 8 is a perspective view of the seventh preferred embodiment of a cup ornamented with a rotatable member according to this invention.
Figure 9:
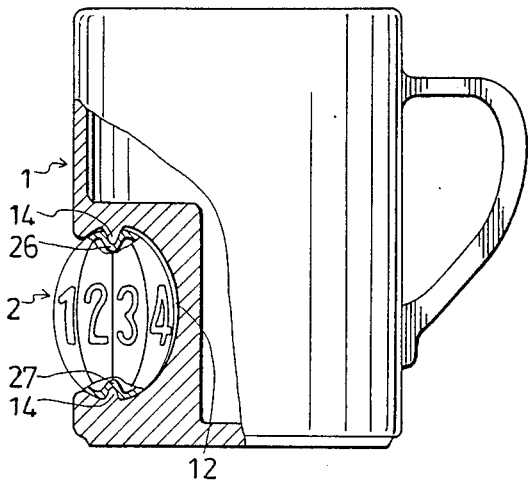
FIG. 9 is a partially sectional side view of the eighth preferred embodiment of a cup ornamented with a rotatable member according to this invention.

Referring to FIG. 8, another preferred embodiment of a cup 1 of this invention is shown. The rotatable member 2 is in the form of a disk marked with letters which has a central throughbore 26 through which passes a pintle 13 mounted in the cavity 12 of the wall body 10 so that the disc can be rotated about the pintle 13. The rotatable member 2 may be in a form of a ball marked with numbers which has two recesses 27 into which are inserted two opposed pegs 14 formed on the internal surface of the cavity 12 so that said ball can be rotated about an axis formed along the two opposed pegs 14, as best illustrated in FIG. 9.

Figure 10:
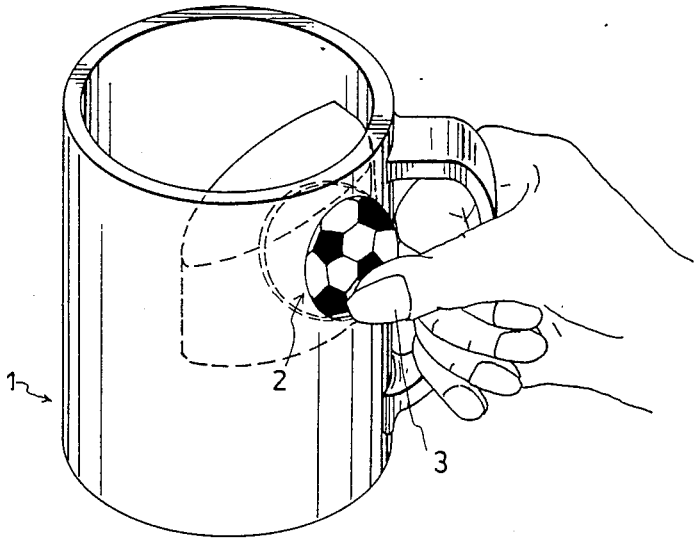
FIG. 10 is a persepctive schematic view showing the ninth preferred embodiment of a cup ornamented with a rotatable member according to this invention, wherein the rotatable member is rotated by a user's finger.

Referring to FIG. 10, a perspective view of still another preferred embodiment of a cup 1 of this invention in an operative position is shown. In this embodiment, the rotatable member 2 received in said cup 1 can be rotated by a user's fingers 3 when the cup 1 is held by the user to serve as a dynamic ornament of said cup 1, enhancing the aesthetic quality thereof.

Figure 11:
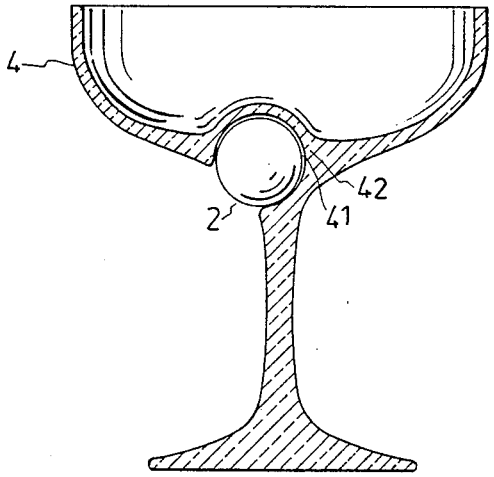
FIG. 11 is a sectional view of the tenth preferred embodiment of a cup ornamented with a rotatable member according to this invention.

Referring to FIG. 11, yet another preferred embodiment of a piece of stemware 4 of this invention is shown. The piece of stemware 4 has a rotatable member 2 in the form of a ball received in a cavity 41 formed in the bowl of 42 of the piece of stemware 4 in a similar manner as described hereinbefore.

Figure 12:
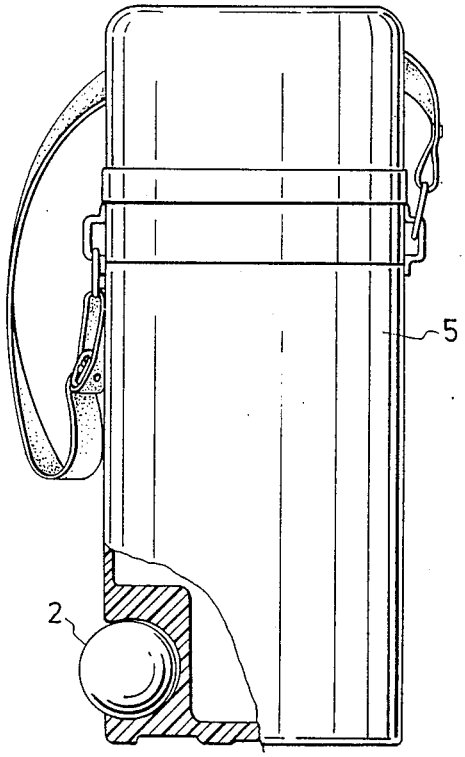
FIG. 12 is a partially sectional side view of the fourth preferred embodiment of a thermos bottle ornamented with a rotatable member according to this invention.

A thermos bottle 5 can also be adorned with a rotatable member 2 in a manner as described hereinbefore so as to increase the attractiveness thereof, as best illustrated in FIG. 12.

It is seen that, in accordance with the present invention, the aesthetic quality of a beverage container adorned with a rotatable member can be enhanced, not only by means of the attractive appearance of a rotatable member of a variety of forms, but also by the spinning of the rotatable member which serves as a dynamic ornament when the rotatable member is rotated by a user's fingers.

With this invention thus explained, it is apparent that numerous modifications and variations can be made without depending from the scope and spirit of this invention. It is therefore intended that this invention be limited only as indicated in the appended claims.

We claim:

1. A container comprising a wall body having an external wall surface and a internal wall surface, said wall body having a projection extending inwardly from said internal wall surface thereof and a cavity extending inwardly from said external wall surface thereof into said projection with an opening which is located at said external wall surface; and a rotatable member rotatably and unremovably received within said cavity, said rotatable member having a portion thereof protruding out from said opening of said wall body, whereby said rotatable member can be rotated by a user's fingers so as to enhance the aesthetic quality of said beverage container.

2. A container as claimed in claim 1, wherein said rotatable member is a hollow transparent ball which is half-filled with water and has a buoy floating on the surface of said water.

3. A container as claimed in claim 1, wherein said rotatable member is a ball having a plurality of bores formed therein in which a plurality of jingle bells are received.

4. A container as claimed in claim 1, wherein said rotatable member is a ball having a checkered external surface.

5. A container as claimed in claim 1, wherein said rotatable member is a ball having an external surface marked with a plurality of dice pips.

6. A container as claimed in claimed in 1, wherein said cavity of said wall body has a pintle mounted therein which passes through a central throughbore formed in said rotatable member so that said rotatable member can be rotated about said pintle.

7. A container as claimed in claim 1, wherein said cavity of said wall body has two opposed pegs protruding from an internal face thereto which are respectively inserted into two recesses formed in said rotatable member so that said rotatable member can be rotated about an axis formed along said two opposed pegs.

* * * * *

UNITED STATES PATENT AND TRADEMARK OFFICE

CERTIFICATE OF CORRECTION

PATENT NO. : 4,932,542

DATED : June 12, 1990

INVENTOR(S) : Chen et al.

It is certified that error appears in the above-identified patent and that said Letters Patent is hereby corrected as shown below:

| Column | Line | |
|---|---|---|
| 2 | 4 | "persepctive" should be --perspective-- |
| 2 | 34 | "container" should be --contained-- |
| 2 | 38 | "from" should be --form-- |
| 2 | 39 | "a external" should be --an external-- |
| 3 | 15 | "depending" should be --departing-- |
| 3 | 20 | "a" should be --an-- |
| 4 | 17 | "claimed in" (second occurrence) should be --claim-- |

Signed and Sealed this

Seventeenth Day of March, 1992

*Attest:*

HARRY F. MANBECK, JR.

*Attesting Officer*

*Commissioner of Patents and Trademarks*